United States Patent [19]

See

[11] Patent Number: 4,558,549

[45] Date of Patent: Dec. 17, 1985

[54] WALL CONSTRUCTION PREFABRICATED FROM INTERCONNECTABLE MODULES

[76] Inventor: Jacques L. See, 3612 Malibu Vista Dr., Malibu, Calif. 90265

[21] Appl. No.: 602,142

[22] Filed: Apr. 19, 1984

[51] Int. Cl.[4] ..... E04B 5/48

[52] U.S. Cl. ..... 52/220; 52/580; 52/582; 52/587; 52/508; 52/828

[58] Field of Search ..... 52/220, 580, 582, 587, 52/588, 594, 807, 285, 540, 541, 593

[56] References Cited

U.S. PATENT DOCUMENTS

| | | | |
|---|---|---|---|
| 2,432,563 | 1/1944 | Drake | 52/828 X |
| 3,413,765 | 12/1968 | Williams et al. | 52/807 X |
| 3,476,634 | 11/1969 | Fleischmann | 52/587 X |
| 3,831,330 | 8/1974 | Tacke et al. | 52/220 |
| 4,428,993 | 1/1984 | Kohn et al. | 52/807 X |
| 4,437,281 | 3/1984 | See et al. | 52/508 X |
| 4,517,232 | 5/1985 | Krauser | 52/588 |

FOREIGN PATENT DOCUMENTS 1235558 3/1967 Fed. Rep. of Germany .

*Primary Examiner*—Carl D. Friedman
*Assistant Examiner*—Creighton Smith
*Attorney, Agent, or Firm*—Fraser and Bogucki

[57] ABSTRACT

In a wall construction prefabricated from interconnectable complementary panels each of the panels includes a pair of generally rectangular, offset planar surfaces and a number of metal interconnectors attached thereto at least along the margins for interengagement with complementary interconnectors along like margins of other panels. Flat panels and other shapes may be joined together with different offset relationships in order to achieve desired wall and panel geometries while securing panels together.

16 Claims, 12 Drawing Figures

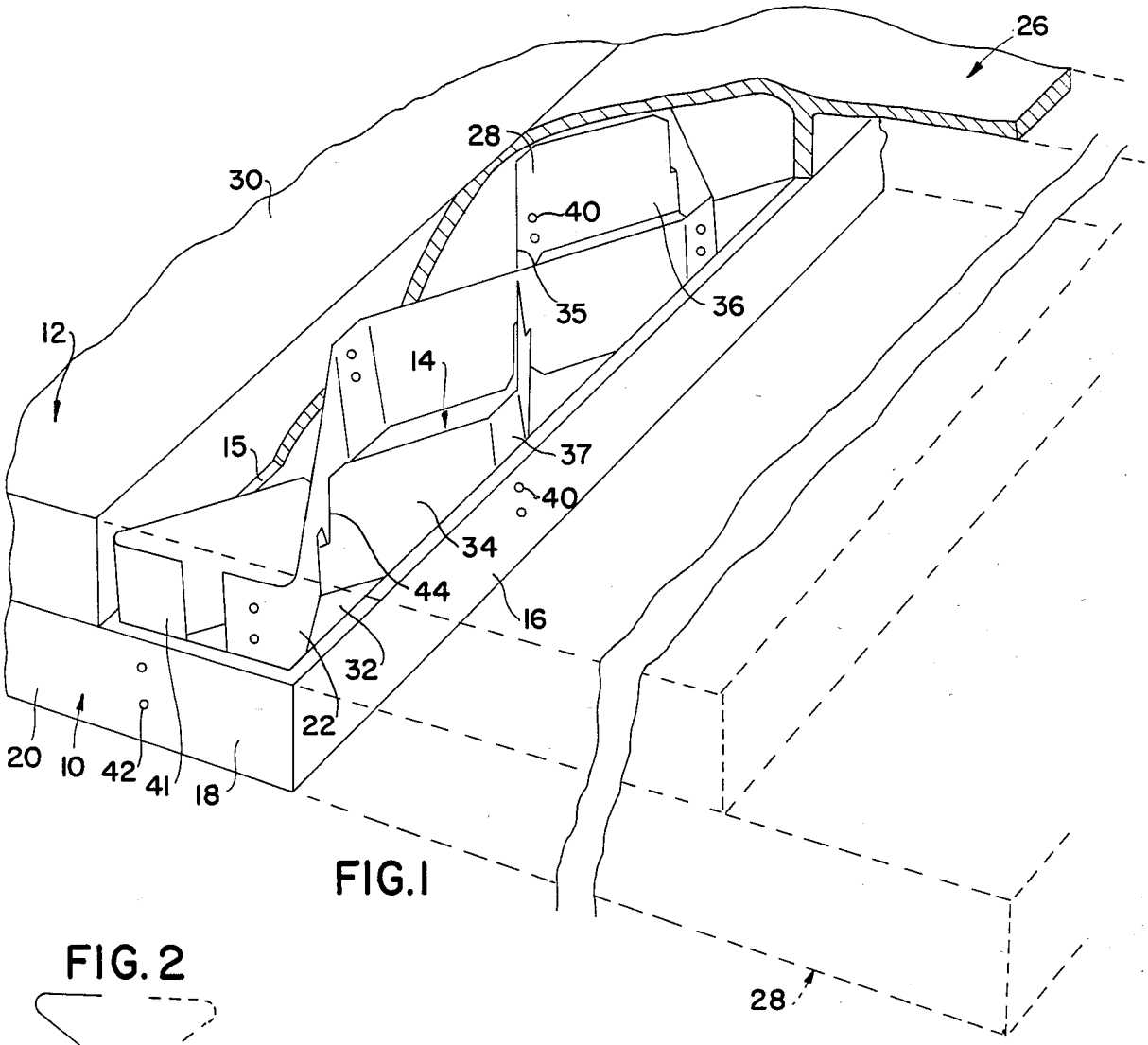
FIG.1
FIG. 2
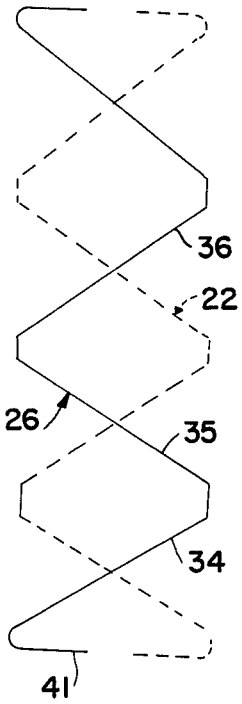
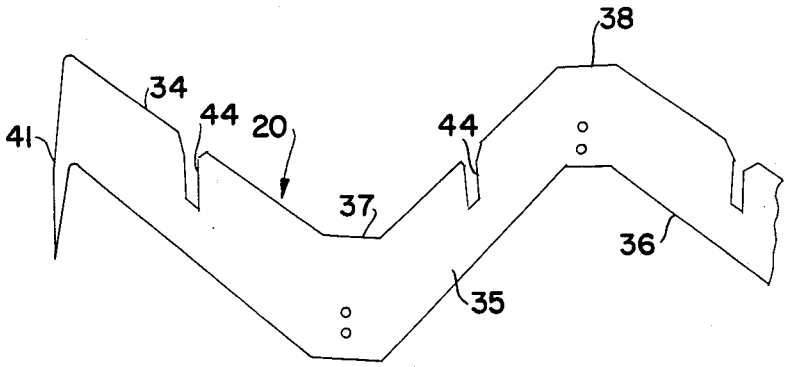
FIG.3

WALL CONSTRUCTION PREFABRICATED FROM INTERCONNECTABLE MODULES

BACKGROUND OF THE INVENTION

1. Field of the Invention

This invention relates generally to structural elements, and more particularly to standard modules useful as easily assembled walls, building panels, and the like.

2. Description of the Prior Art

U.S. Pat. No. 4,437,281, issued Mar. 20, 1984 to S. V. L. Chevanne and myself, discloses double wall hollow panels constructed by a nesting operation wherein two elements or modules can be doubly off-set or staggered. Each of the modules used in this construction is divided into a number of compartments by cross-pieces, and the compartments are further subdivided by ribs forming diagonals and interengageable with similar ribs of a mating module. Each of the diagonal ribs is provided on one side with opposing teeth which cooperate with complementary elements in the facing diagonal rib so as to enable the two halves to be snapped together and locked in place. This arrangement enables the halves to be offset or staggered in assembling complete walls and panels of a desired configuration. While it is desired to maintain this versatility the costs of molding the panels including the integral cross-pieces and the diagonals can be substantial, and certain limitations are also imposed on modular assembly by the square module geometries.

Numerous proposals have been made for constructing buildings, and the like, from standard components. Examples of prior proposals can be found in U.S. Pat. Nos.: 4,408,423, issued Oct. 11, 1983, to R. W. Lautenslager et al; 4,388,789, issued June 21, 1983, to W. T. Murphy; and 3,290,845, issued Dec. 13, 1966, to M. K. Snyder. The first of these prior constructions deals with the support of roofs, while the latter two arrangements are concerned with the integrity of joints between adjacent components in a building panel system.

French Pat. No. 2,045,553, published May 3, 1971, and naming A. Maindron as inventor, discloses standard elements which can be combined into matrix assemblies for decorative purposes. Austrian Pat. No. 338,478, published Aug. 25, 1977, discloses the use of a plurality of interlocking standard elements to form a rectangular panel member, while French Pat. No. 1,423,313, published Nov. 22, 1965, with Bergerioux et al, being listed as inventors, discloses a construction module comprising an outer rectangular element in which a rectangular internal element is arrangeable so that various cavities formed in the interior element are properly arranged for facilitating attachment of the interior element to the exterior element. French Pat. Nos. 2,182,118, published July 12, 1973, and 2,007,695, published Jan. 9, 1970, disclose further examples of construction techniques employing interlocking standard elements. Such prior modular assemblies are not as versatile as the nesting double wall configuration of U.S. Pat. No. 4,437,281, and do not afford comparable cost or fabrication advantages.

SUMMARY OF THE INVENTION

A number of advantageous objects are achieved according to the present invention by standard modular panel components incorporating attached interior interconnectors that are separately fabricated and attached along at least two margins to provide a number of options for assembly. The modules are formed so as to provide panel halves of readily molded and inexpensive material, each receiving separately formed and attached interconnector elements that are principally flat and substantially perpendicular to the plane of the panel. A part of each interconnector extends above the panel half itself and is configured to fit in complementary fashion with a like but oppositely angled element on a facing module. Further, these interconnector elements are disposed in a repetitive pattern along at least the margins such that panels may be joined in offset relation to form a continuous self supporting structural wall. Particular units may be attached in like fashion to provide corners and other transitions.

One interconnector structure is defined by sinuous metal strips defining successive diagonal lengths of alternating slope and including both a complementary matable shape and means for attaching to the panel part. This locking interconnector structure is in a form which may be stamped or rolled by a continuous metal forming process. The same is true of a variant shaped as a folded member of defining a linear ridge and having a base flange which may be secured to the panel as a diagonal rib. Such members may be configured with upstanding cylindrical segments to receive threaded elements for secure engagement to the module body or panel face. The quadrant volumes about the united interconnections may be filled with insulating material in all of these forms.

In another example in accordance with the invention, the interconnector elements are configured with sinuous end sections enabling resilient longitudinal shifting of the center portion which engages another complementary part, so as to accommodate misalignment and insure more secure locking.

Further, another aspect of the invention is that the modular offset panel halves may be configured with flat panel surfaces of rectangular outline without internal subdividing ridges or peripheral ridges. Z-shaped separators are used to determine spacing and provide strengthening of the panel surfaces of rectangular outline, with formed metal interconnectors along at least two sides providing the needed positioning and engagement to adjacent panels. The space between the separators may be filled with insulation. Furthermore tubular end pieces may be used to close off the opening between the panels and arranged such that they can receive wires and piping. Using this modular system a continuous wall or other structure may be assembled from lost cost components readily and without special tooling.

Such locking interconnectors permit versatile assembly of offset modular panel halves into desired geometries, and substantially reduce the cost of manufacture by simplifying the molding process and molding costs. In addition the interconnectors may incorporate stamped or punched teeth which secure rigid foam or other insulative blocks within the interior of a module. The inserted interconnectors may also be positioned and configured so that particular modular shapes can be used as corner elements or strengthening beams.

BRIEF DESCRIPTION OF THE DRAWINGS

A better understanding of the invention may be had by reference to the following description, taken in conjunction with the accompanying drawings, in which:

FIG. 1 is a perspective view, partially broken away, showing a wall construction module and interconnection system according to the present invention;

FIG. 2 is a diagrammatic, fragmentary view, showing the manner in which the interconnectors of the modules illustrated in FIG. 1 engage with one another;

FIG. 3 is a perspective view, partially broken away, showing an individual interconnector of the example of FIG. 1;

DETAILED DESCRIPTION OF THE INVENTION

Figure 4:
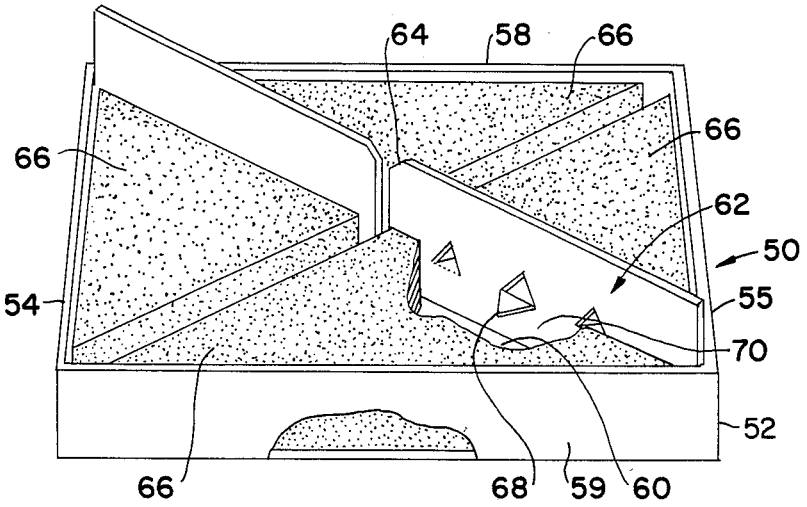
FIG. 4 is a perspective view, partially broken away and in section, showing a second form of interconnecting element useful in a wall construction module according to the present invention.

FIGS. 1–3, to which reference is now made, depict a novel construction modular and interconnection device in accordance with the invention. As described in previously referenced U.S. Pat. No. 4,437,281, a module forms half an offset panel, and a wall construction, for example, may be built up of a series of these offset pairs. FIG. 1 shows a lower module 10 on which an upper module 12 is disposed in staggered relation, leaving an exposed compartment 14 defined by longitudinal side walls 15, 16 and the end wall 18 of the module 10. The exposed compartment 14 is not configured with integral cross pieces within a series of like compartments, but instead incorporates a single extended upwardly directed interconnector element 20 as described below.

The interconnector element 20 registers with a like but downwardly directed interconnector 22 in a like edge compartment along the margin of an adjacent overlying upper module 26, the major body of which is shown in phantom. This module 26 fits over another offset lower module 28 shown in phantom that abuts the first lower module 10 previously mentioned.

The locking interconnector element 20 comprises a somewhat sinuously shaped continuous metal strip whose principal surface is perpendicular to the plane of the module 10. Also, the element 20 zig-zags along the length of the exposed compartment 14. The interconnector 20 can be seen, in this example, to include three generally straight successive portions 34, 35, and 36 connected together by a pair of bridge portions 37 and 38. The latter are connected to the side walls 15, 16 in a suitable manner, such as by a pair of rivets 40, although screw fasteners, nails, staples, and the like may alternatively be used. Terminating each end of the interconnector 20 are oppositely directed, but substantially parallel, legs 41, which legs 41 may be attached to the end walls, e.g. 18, by rivets 42. As can be appreciated from FIGS. 1–3, straight portions 34 and 36 are substantially parallel to one another along one diagonal, while the intermediate straight portion 35 is arranged along a substantially oppositely angled diagonal. Each of the aforementioned straight portions includes a central notch 44 disposed along the longitudinal center line of the exposed compartment 14. The complementary notches of the downwardly extending interconnecting element 22 can be received in the notches 41, in the manner shown in FIGS. 1 and 2. While the configuration of the notches 44 can vary as desired and is appropriate, use, as illustrated, of the shape of an open Y has been found satisfactory for guiding cooperating interconnectors such as 20 and 22 into position to join the modules 10, 26. The openings in the notches 41 can be small enough to assure frictional locking without undue pressure. The panel halves formed by the modules 10, 12 may however be separately coupled by bolts, rivets or other conventional means.

The use of these insertable and separately fastened interconnectors materially lowers fabrication costs because panels can be molded with less expensive and complex molds. Although interconnectors can be disposed throughout the entire area of a panel it is also now readily feasible to use exposed compartments and interconnectors only at the offset margins, and these margins can be of a range of widths, from narrow to wide. This feature also substantially reduces module cost. Furthermore, modules of various rectangular outlines can be used, affording greater flexibility in design and assembly. The panel halves or modules can be separately attached and the interior volumes filled with insulation as described in greater detail below.

Referring now to FIG. 4 of the drawings, each unit 50, of a module of the type described in the above referenced patent, may alternatively comprise a frame 52 which is generally square in plan view, and is formed by a pair of substantially parallel, coextensive side rails 54 and 55, and a perpendicularly disposed substantially parallel pair of coextensive end rails 58, 59. A planar member 60 covers one broad face of the module 50 to provide a decorative or protective surface. Extending diagonally between opposed vertices of the module 50 is a connector 62 in the form of a generally flat, longitudinally extending, continuous metal sheet element. The height of the connector 62 is almost double the height of the sides of the module 50, and the connector 62 is provided with a notch 64 disposed substantially midway between the ends and arranged for receiving a connector of a complementary module (not shown). The manner of usage is evident from the above description and the previously mentioned See et al patent.

Figure 5:
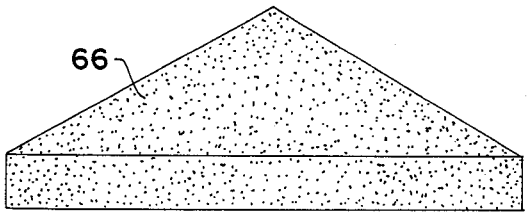
FIG. 5 is a perspective view showing more clearly an insulating material piece used in conjunction with the module illustrated in FIG. 4.
Figure 6:
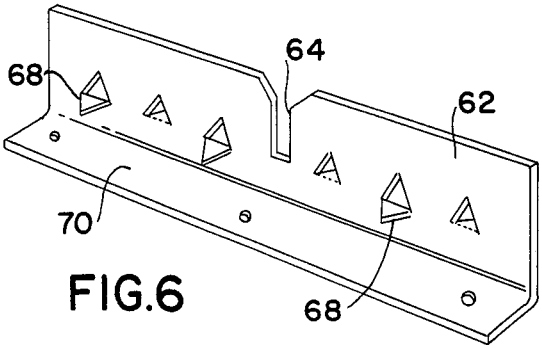
FIG. 6 is a perspective view of an interconnector used with the modular element illustrated in FIG. 4.

As can be seen from FIG. 4, the interposition of a second connector diagonal to the connector 62 divides the module unit 50 into four sections, or quadrants, each receiving a triangular block 66 of a preformed insulation material, such as a suitable, known foamed synthetic resin. Each block 66 of insulation conforms in height to the rails 54, 55, 58, 59 about the module 50, because the complementing module also is provided with such insulation blocks 66, depicted separately in FIG. 5. The connector 62 is itself separately illustrated in FIG. 6 in order to more clearly show projections or teeth 68 arranged extending laterally outwardly from the upstanding surface and a horizontal foot 70 for attachment to the planar member 60. The teeth 68, which may be formed integrally in the connector 62 penetrate the adjacent foam blocks 66 to hold them in place and unify the structure. The teeth 68 advantageously can be formed by cutting triangular portions along the extent of the connector 62 and bending a tab 68 perpendicularly to the plane of the sheet metal.

The triangular foam blocks 66 can also be of full height, so they fill the entire interior of a module, in which event they aid further to unify the assembly.

Figure 7:
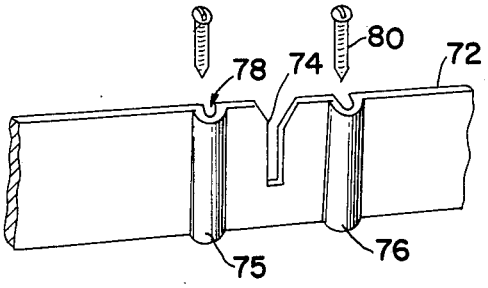
FIG. 7 is a fragmentary, perspective view, showing a different interconnector similar to that used in the module illustrated in FIG. 4, but provided with receptacles for receiving an attachment member.

FIG. 7 shows a different feature that can be incorporated in a connector 72 having an interlocking notch 74. The connector body is formed with closed or substantially closed vertical cylinders 75, 76 each defining a through bore 78 for receiving a screw fastener 80, bolt, or the like. Preferably, each of the cylinders 75, 76 is immediately adjacent the notch 74, so as to permit rigidification of that portion of the assembly by anchoring the connector 72 to, for example, an associated planar member (not shown), which can be above or below.

Figure 8:
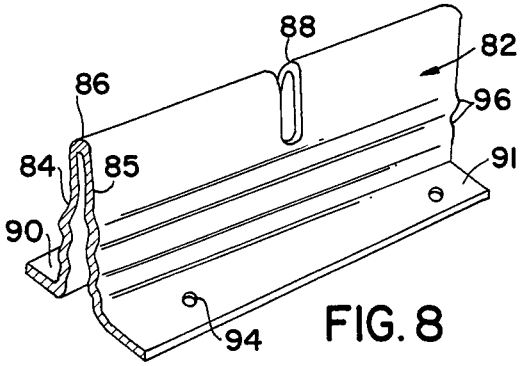
FIG. 8 is a perspective view showing another form of interconnector.

Referring now to FIG. 8, a connector 82 is shown which can be employed with a frame such as previously described, with particular advantages in strength and locking capabilities. Connector 82 is generally U-shaped in transverse section and includes a pair of substantially parallel, or slightly diverging, legs 84, 85 joined by a bight portion 86. Midway along the connector 82 is a notch 88 configured appropriately for receiving a cooperating connector element, which is not shown but may be identical to element 82. Each of the legs 84, 85 terminate in transverse flanges 90, 91 extending laterally to permit anchoring of element 82 to an associated frame (not shown). Flanges 90, 91 are provided with suitable openings 94 for receiving conventional fasteners (not shown), to anchor connector 82 to a cover member or facing sheet (also not shown).

Each of the legs 84, 85 of connector 82 have a plurality of reinforcing corrugations 96 arranged along the length of the connector 82. The folded over connector 82, therefore, may be stamped, rolled and formed into shape readily, and forms a particularly strong unit that is easily attached. However, it is also resilient and provides strong gripping action between the notches 88 and the corrugations 96 received within them.

A different modular panel system and interconnector arrangement is shown in FIGS. 9–12, to which reference is now made. Each of the previously described connectors can be used in this system, which differs in material respects from U.S. Pat. No. 4,437,281. Here the offset panel faces 100, 102 are simply flat members, with no internal compartments. The panels 100, 102 are held separated and are strengthened by longitudinal metal strips or angle sections 104, 106, which are joined to one or the other of the panels 100, 102. These strips 104, 106 have a vertical rib for load resistance and orthogonal end members for attachment to the panel faces 100, 102, but could also be U-shaped or otherwise configured channel members. The strips 104, 106 terminate short of the panel 100, 102 ends toward which they extend, leaving a margin within which offset hollow tubular members 108, 110 (here rectangular in cross-section) are positioned so as to close off the assembled panel halves. The tubular members 108, 110 are themselves relatively offset so as to be differently coextensive with a different one of the two flat panels 100, 102. Thus enclosed pathways, open at the ends, are available for insertion of tubing or wiring, or both, within the assembled wall structure. Tubular members 108, 110 may curve inwardly into the module interior to lead to access points for water or electricity (not shown) on the panel surface. Special pathways for circuits and tubing are easily attached because the entire unit is open before the halves of a module are joined together.

The space between the two flat panels 100, 102 may be filled with insulation, such as foam block (not shown), glas fiber mat, or foam that is expanded in place. In this form of construction the panel sections are of a standard size (e.g. 4'×8') so that the overlap regions along each margin are in the range of approximately 9" in width and interconnectors are disposed along only the long edges, except where windows, doors and other openings are included. The assembly of FIG. 9 defines a panel 112 in which the two halves may be positioned and held together by interconnectors (not shown) between the strips 104, 106. However in this example no interior interconnectors are used and the panel faces 100, 102 are united by fastening to the strips 104, 106 themselves. The panel 112 has an array of interconnector elements 114 along each of two parallel and offset margins, these elements 114 being oppositely directed for positioning and engagement, as described below.

Figure 10:
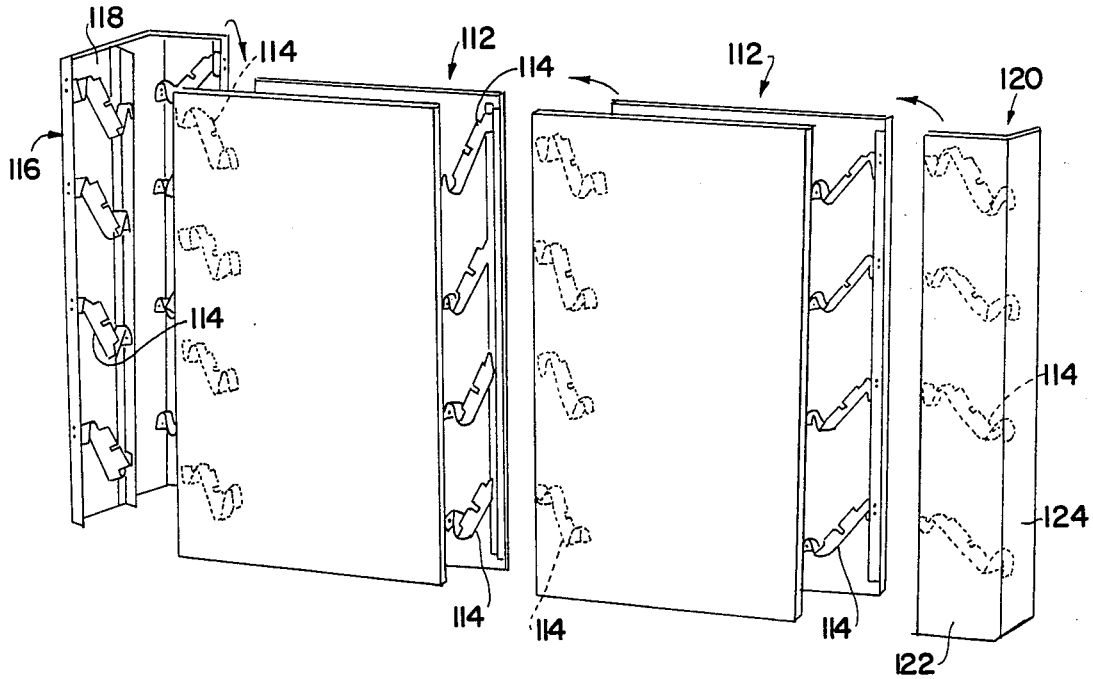
FIG. 10 is a perspective and exploded view of a series of panels and components that may be assembled into a wall section.
Figure 11:
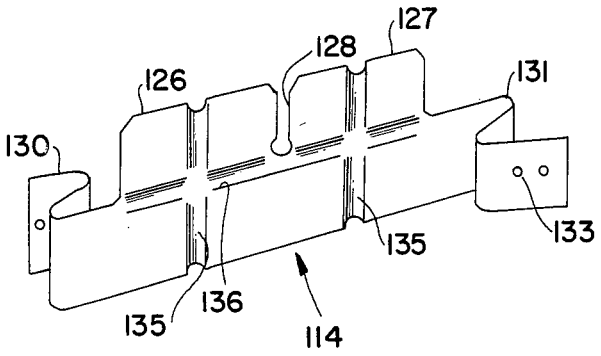
FIG. 11 is a perspective view of an individual interconnection element used in the arrangement of FIGS. 9 and 10.

As seen in FIG. 10, the panels 112 are quickly assembled on a site by joining the halves together in staggered relationship to form the separate panels 112, each with exposed interconnectors 114 along each vertical side, but facing in opposite directions. In a vertical wall as shown inwardly and outwardly facing interconnectors 114 on the panels 112 join at the overlap regions to form a continuous structural surface which typically incorporates interior insulation and conduits as previously described, although for simplicity these are not shown in FIG. 10.

At the ends of the wall sections assembled from individual panels 112, particularly adapted mating pieces can be attached to provide needed transitional structural features. Thus at the corner of a structure an L-angle section 116 having inwardly facing interconnectors 114 along a side to complement the outwardly facing interconnectors 114 on the adjacent panel 112 is coupled into position so as to form the corner. A longer arm 118 of the L-angle section 116 extends beyond the width of the panel 112 to support another set of interconnectors 114 for receiving an orthogonally placed panel (not shown) starting the next wall.

Figure 9:
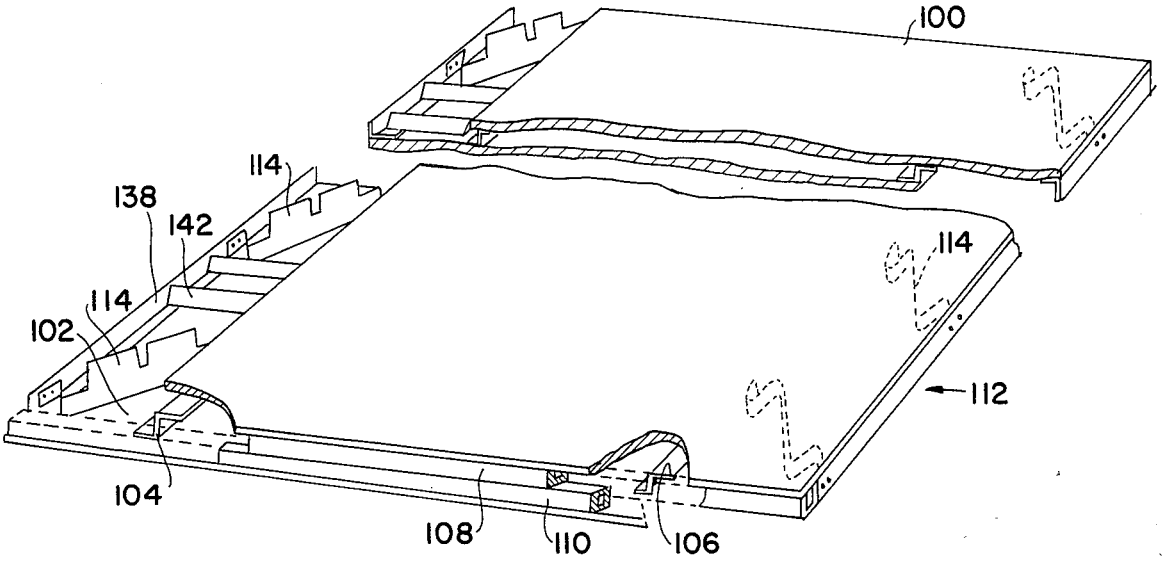
FIG. 9 is a perspective view, partially broken away, showing still another form of a wall construction module and interconnector device according to the present invention.

At the opposite (right hand) end of the wall assembly that is shown another particularly adapted angle section 120 fits over the exposed margin of the right hand panel 112, providing a main surface closure strip 122 and an end strip 124. Appropriately angled interconnectors 114 extend outwardly to mate with the interconnectors 112 along the panel 112 margins. An interconnector such as used in the exemplification of FIGS. 9 and 10 is shown in greater detail in FIGS. 11 and 12 to which reference should be made along with FIG. 9. The interconnector 114 is of flat sheet metal and is shaped so that it may be initially formed by a continuous fabricating or sequential stamping technique. It incorporates a substantially straight body portion of constant height in the end regions and with two higher ears 126, 127 in the intermediate linear region defining a central notch 128, consistent with what has been previously described. However, the end sections 130, 131 each are formed with a double reentrant curvature, providing a resilient coupling between end fastener positions 133 (shown as rivet, spot weld or nail points) and the central notch 128 region. The interconnector 114 also includes vertical and horizontal stiffening ribs 135, 136 respectively.

Figure 12:
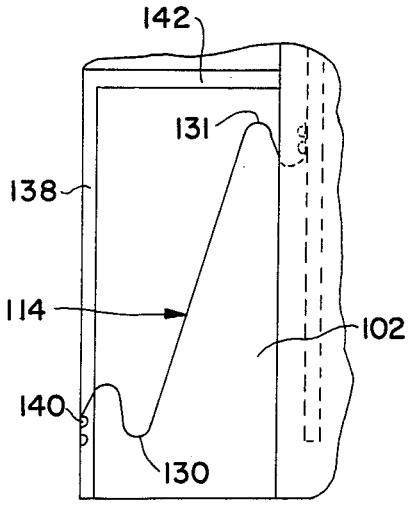
FIG. 12 is a diagrammatic, plan view, showing an interconnector in the module of FIG. 9.

As seen in FIGS. 9 and 12, the interconnectors 114 are mounted in position by coupling to an L-shaped strip 138 along a panel 102 margin at one side and to a Z-shaped strip 104 at the other side. A pair of rivets 140 (FIG. 12) may couple the terminal portions of each end section 130 to the strips 138, 104 respectively. Cross pieces in the form of transverse triangular strips 142 are mounted between the interconnectors to provide structural reinforcement.

By overlying the marginal panel 112 sections with the interconnectors 114 properly facing, precise placement and secure locking is assumed. The central sections with the notches 128 can adjust to compensate for misalignment and thereafter hold securely in place under spring force. Thus fewer connectors need be used to achieve the desired effects. Also this configuration provides freedom from the need for compartments into which the connectors are placed. This means that flat outside sheet surfaces can be used, so that special molds are not required. The abutting edges of two flat surface panels are joined by tape or the joinder region (or entire wall) can be covered with an insulating or fireproofing layer.

As can be readily understood from the above description and from the drawings, construction modules according to the present invention permit entire structures to be constructed with as few as one unit design being required. With only a few panel designs prior structures can be assembled in a simple yet efficient and rugged manner.

The system of FIGS. 9 and 10 thus provides a novel form of modular construction providing easy joinder of wall sections which can have structural strength without added interior beams, although these can be used if desired. Insulation can be inserted not only within the interior throughout the coextensive portion of the panels, but also within the overlapping marginal portions, because the interlocking metal elements provide adequate space, as shown in FIG. 4.

Although various forms and variations in accordance with the invention have been described, it will be appreciated that the invention is not limited thereto but encompass all expedients and modifications falling within the scope of the appended claims.

What is claimed is:

1. A modular wall construction in which half thickness modules are assembled in facing but off-set relation and positioned and coupled by joinder elements comprising:

first and second planar face panels to be coupled together in spaced apart parallel but off-set relation with exposed marginal regions;

sheet metal interlock elements positioned along at least two edges of the face panels in the exposed marginal regions, the interlock elements being generally perpendicular to the panels and having heights greater than one-half the desired spacing between the panels, and forming more than one diagonal length, each diagonal length having an intermediate notch, the angles of the diagonals of facing panels being such that the diagonals intersect and the notches frictionally engage to the other interlock element, and the interlock elements on a marginal region on a face panel being positioned such that the notch can be entered from the direction of the other face panel; and means coupling the interlock elements to the panels.

2. The invention as set forth in claim 1 above, wherein the interlock elements have integral feet portions in contact with the panels with which they are associated and the means coupling the interlock elements to the panels secure the feet of the interlock elements to the planar face of the panels.

3. The invention as set forth in claim 2 above, wherein the interlock elements comprise elements folded along a center line and including lengthwise corrugations therealong adjacent the notches for strengthening the elements and providing frictional engagement between the sides of the notches and the corrugations.

4. The invention as set forth in claim 1 above, wherein the construction further includes block insulation means disposed between the diagonals along the interlock elements, the insulation means comprising triangular blocks disposed in quadrants defined by the diagonals and wherein the interlock elements include side projections integral therewith and extending outwardly therefrom to engage the insulation means.

5. The invention as set forth in claim 1 above, wherein the interlock elements include means providing resilient displacement of the diagonals along the lengths thereof; comprising sinuous end configurations defining reentrant curves, wherein the coupling means joins the interlock elements to the panel at the outer ends of the interlock elements and the intermediate portions including the notches are resiliently displaceable along their lengths by resilient displacement of the end configurations.

6. The invention as set forth in claim 5 above, wherein the construction further includes metal strips along the edges of each marginal region coupled to at least one of the face panels, means attaching the interlock elements to the metal strips, and tubular means disposed along one edge of the face panels to close the gap therebetween and provide conduit for piping or wiring.

7. The invention as set forth in claim 1 above, wherein the construction includes means between the face panels for separating the face panels at a desired spacing to define other margins, wherein the interlock elements are oppositely directed from the respective margins, and wherein the edges of the panels directly abut and the means separating the face panels include longitudinal strips disposed along the edges of the offset margins and attached to both face panels.

8. The invention as defined in claim 1, wherein the sheet metal interlock elements include cylindrical means formed integrally within the strip and defining at least one aperture perpendicular to the face panels for receiving attachment means therein to secure the interlock element to the planar surface of the face panel.

9. In a wall construction prefabricated from interconnectable modules complementary with one another, each of the modules complementary with one another, each of the modules including a generally rectangular, planar frame, the improvement comprising interconnector means attached to the frame along at least one side margin thereof for interengagement with complementary means interconnecting along a side margin of another of the modules, wherein the interconnector means comprises a continuous interconnector sheet metal element substantially perpendicular to the plane of the frame and including interengagement means protruding from the plane of the frame for joinder with the interengagement means in the interconnector means of an interengaging module; and wherein the interconnector element is sinuously shaped of successive oppositely angled diagonals in a plane substantially perpendicular to the plane of the frame.

10. The invention as defined in claim 9, wherein the frame includes a generally rectangular compartment along the side margin of the module, a planar member arranged covering the framework on a one side thereof, and wherein each of the notches is in the shape of an open Y and wherein compartments open in opposite directions are included along parallel and spaced apart side margins of the module.

11. An interconnector element defining at least one diagonal in a building panel half that is to be positioned and secured to a complementary panel half having at least one oppositely included interconnecting element comprising a sheet metal element whose principal plane is perpendicular to the panel half and extends therefrom, the interconnector element including a notch in the central region of the diagonal for receiving a like notch in an inserted complementary interconnector; and wherein the interconnector element is generally U-shaped in section, and including a pair of substantially parallel legs being joined by a bight portion, the notch being formed in the bight portion, and at least one of the legs terminating in a flange, the flange being disposed in spaced relation to the bight portion and arranged extending laterally from the associated one of the legs for permitting attachment of the element to an associated frame in a plane perpendicular to the parallel legs.

12. The invention as defined in claim 11, wherein each of the legs of the U-shaped element have a plurality of reinforcing corrugations arranged extending between the ends of the element and parallel to the length of the element and providing frictional engagement with the notch in an inserted complementary interconnection.

13. A building wall or panel construction formed by interconnectable planar units comprising:

a pair of face panels;

means for joining the face panels together in parallel spaced apart relation, with the face panels being offset such that parallel offset side margins are established;

interconnector means disposed along each side margin, the interconnector means comprising metal strip elements each defining a succession of diagonals lying perpendicular to the face panels and each including spaced notches arranged along a common central line with respect to the offset side margins for receiving an interconnector means extending from the side margin of a complementing panel, the interconnector means along the side margins being oppositely directed; and means for attaching the interconnector means to the face panels.

14. The invention as defined in claim 13, wherein the means for joining the face panels together comprises at least a pair of metal strips therebetween attached to the face panels, and including in addition second metal strips coupled along the extreme edges of the side margins, and means for attaching the interconnector means to the spaced apart metal strips along the opposite sides of the side margins.

15. A modular wall construction in which half thickness modules are assembled in facing but off-set relation and positioned and coupled by interior joinder elements comprising:

first and second planar face panels to be coupled together in parallel but off-set relation by the use of exposed marginal regions, the planar face panels including side members defining the marginal regions as rectangular shapes;

sheet metal interconnector means disposed in the marginal regions of each of the planar face panels, the interconnector means each comprising a continuous sheet metal element sinuously shaped of successive oppositely angled diagonals in a plane substantially perpendicular to the plane of the panel, and extending between diagonals into proximity with alternating ones of the side members defining the marginal region in which it is positioned, the sheet metal elements including notches in each diagonal along a common centerline within the marginal region, the notches being on the side facing the opposed planar face panel, and the diagonals within the opposed panels being oppositely directed when the panels are coupled together such that the notches register together in frictional engagement, and means coupling the sheet metal elements to the side margins where they are in proximity.

16. A modular wall construction in which half thickness modules are assembled in facing but off-set relation and positioned and coupled together by interior joinder elements, comprising:

first and second planar face panels to be coupled together in parallel but off-set relation by the use of exposed marginal regions, the planar face panels including at least two parallel side members defining limits of the marginal regions;

sheet metal interconnector elements disposed in the marginal regions of each of the planar face panels and extending between the side members, the interconnector elements each having a central substantially linear section on a diagonal relative to the side members, the linear section having a central notch therealong facing the opposed panel, the diagonals of the interconnector elements of the two panels being oppositely directed and the notches registering and frictionally engaging, the sheet metal elements further including integral flexible end sections having reentrant curves such that the linear sections can adjust along their lengths under spring force when the notches register, the end sections including terminal portions in proximity to the side members at the opposite sides of the marginal region; and means coupling the terminal portions of the sheet metal elements to the side members to which they are in proximity.

* * * * *